US005634177A

United States Patent [19]

Taguchi et al.

[11] Patent Number: 5,634,177

[45] Date of Patent: May 27, 1997

[54] APPARATUS FOR DEVELOPING AN ELECTROSTATIC LATENT IMAGE WITH A NON-MAGNETIC TONER

[75] Inventors: Hironori Taguchi, Saga-ken; Hiromitsu Shimazaki, Fukuoka-ken; Akihiro Tsuru, Kitakyushu; Kazuhiko Noda; Yoshihiro Gotou, both of Chikushino; Osamu Doi, Kitakyushu; Hideki Yasuda, Kasuga, all of Japan

[73] Assignee: Matsushita Electric Industrial Co., Ltd., Osaka, Japan

[21] Appl. No.: 612,228

[22] Filed: Mar. 7, 1996

[30] Foreign Application Priority Data

Mar. 15, 1995 [JP] Japan ..... 7-056025
Sep. 20, 1995 [JP] Japan ..... 7-241153

[51] Int. Cl.[6] ..... G03G 15/06

[52] U.S. Cl. ..... 399/103

[58] Field of Search ..... 355/215, 245, 355/246, 259; 222/DIG. 1

[56] References Cited

U.S. PATENT DOCUMENTS 4,792,831 12/1988 Takeda et al. ..... 356/215
5,170,213 12/1992 Yamaguchi et al. ..... 355/246
5,389,732 2/1995 Sekino ..... 355/215 X

FOREIGN PATENT DOCUMENTS 6-52448B2 10/1985 Japan .
6-77167B2 10/1986 Japan .

*Primary Examiner*—Arthur T. Grimley
*Assistant Examiner*—Sophia S. Chen

[57] ABSTRACT

A developing apparatus has a toner reservoir for holding a non-magnetic toner, a toner supply roller including a supply surface for receiving the toner from the toner reservoir and electrifying the toner thereon, an electrostatic latent image carrier including a curved or flat latent image surface on which a latent image formed by an electrostatic voltage distribution thereon is developed by the toner transferred from the supply surface, and a toner seal surface arranged adjacent to the toner supply roller to contact a remaining part of the toner on the supply surface after the latent image development so that the remaining part of the toner is taken into the toner reservoir. The respective frictional coefficients between the toner seal surface and the toner and between the toner particles are selected to prevent a disturbance of toner condition between the toner and the toner seal surface.

7 Claims, 4 Drawing Sheets

$\mu_S > \mu_T > \mu_D$

FIG. 6

TABLE 1

| | SEAL MATERIAL | TONER SCATTER | |
|---|---|---|---|
| SAMPLE 1 | PTFE | ◎ | |
| SAMPLE 2 | PET | ○ | |
| SAMPLE 3 | URETHANE RUBBER | △ | |
| SAMPLE 4 | SILICONE RUBBER | × | LARGE AMOUNT OF TONER ADHERED ONTO SEAL SURFACE |

FIG. 7

TABLE 2

| | SEAL MATERIAL | SEAL PRESSURE | TONER SCATTER | B.G. DENSITY | |
|---|---|---|---|---|---|
| SAMPLE 5 | PTFE | 10 ( g/cm ) | △ | 0.47 | |
| SAMPLE 6 | PTFE | 15 | ○ | 0.41 | |
| SAMPLE 7 | PTFE | 20 | ○ | 0.38 | |
| SAMPLE 8 | PFA | 25 | ◎ | 0.31 | |
| SAMPLE 9 | PFA | 30 | ◎ | 0.35 | |
| SAMPLE 10 | PFA | 40 | × | 0.40 | |
| SAMPLE 11 | PTFE | 50 | × | 0.30 | LARGE AMOUNT OF TONER WELDED ON SEAL SURFACE |

APPARATUS FOR DEVELOPING AN ELECTROSTATIC LATENT IMAGE WITH A NON-MAGNETIC TONER

RELATED ART STATEMENT

The present invention relates to a developing apparatus for developing an electrostatic latent image with a non-magnetic toner.

BACKGROUND OF THE INVENTION

In the prior art disclosed by JP-B1-6-77167, an electrified toner and a toner seal for preventing the toner from flowing out from a toner reservoir slide relative to each other to generate triboelectricity therebetween, and an absolute value of voltage with triboelectricity of the toner seal is higher than that of the electrified toner contacting the toner seal.

SUMMARY OF THE INVENTION

An object of the present invention is to provide a developing apparatus for developing an electrostatic latent image with a non-magnetic toner, preferably for preventing the toner from flowing out from a space between a toner supply roller and a toner seal adjacent to each other, and/or preferably for preventing the toner from undesirably separating away from or remaining on the toner supply roller.

According to the present invention, a developing apparatus comprises a toner reservoir for reserving a non-magnetic toner, a toner supply roller including a substantially cylindrical supply surface for receiving the toner from the toner reservoir and electrifying the toner thereon, an electrostatic latent image carrier including a curved or flat latent image surface on which a latent image formed by an electrostatic voltage distribution thereon is developed by the toner transferred from the supply surface, and a toner seal surface arranged adjacent to the toner supply roller to contact a remainder part of the toner on the supply surface after the latent image development so that the remainder part of the toner is taken into the toner reservoir, wherein a disturbance of condition in voltage and/or slide between the toner and the toner seal surface is prevented.

Since the disturbance of condition in voltage and/or slide between the electrified toner and the toner seal surface is prevented, a repelling or attracting electrostatic or coulomb force between the electrified toner and the latent image surface is not decreased so that the toner is prevented from being undesirably transferred from the supply surface to the latent image surface or remaining on the supply surface, and the toner held on the supply roller is smoothly introduced into the toner reservoir so that the toner is prevented from flowing out from a space between the toner supply roller and the toner seal surface.

When a frictional coefficient between the toner seal surface and the toner is lower than a frictional coefficient between the toner and the toner, a slide between the supply surface and the toner seal surface is prevented from occurring in the toner to maintain a shape of the toner on the supply surface. When the frictional coefficient between the toner seal surface and the toner and/or a frictional coefficient between particles of the toner is lower than a frictional coefficient between the toner and the supply surface, the toner between the supply surface and the toner seal surface is securely held on the supply surface so that the toner is securely introduced into the toner reservoir in accordance with a rotation of the supply roller. The frictional coefficient is preferably a static or static-dynamic-boundary frictional coefficient. The static frictional coefficient is measured just before a frictional relative movement between two frictional elements contacting each other starts to occur. The static-dynamic-boundary frictional coefficient is measured just when or just after (for example, before a speed of the frictional relative movement reaches 0.1 mm/sec) the frictional relative movement starts to occur. The frictional coefficient may be a dynamic frictional coefficient.

It is preferable for maintaining desirably the shape of the toner on the supply surface to set a pressing force between the toner seal surface and the supply roller not more than 30 g/cm.

When an absolute value of voltage of the toner seal surface is lower than that of the electrified toner between the toner seal surface and the supply surface while triboelectricity (frictional electricity) is generated between the toner and the toner seal surface, the absolute value of voltage of the toner electrified on the supply surface is increased by the triboelectricity, so that the repelling or attracting electrostatic or coulomb force between the electrified toner and the latent image surface is increased. It is necessary for making the absolute value of voltage of the toner seal surface lower than that of the electrified toner between the toner seal surface and the supply surface while the triboelectricity is generated between the toner and the toner seal surface that a material of the toner seal surface is between a material of the toner and a negative end in series of frictional electrification when the toner is electrified on the supply roller to have positive electricity or that the material of the toner seal surface is between the material of the toner and a positive end in the series of frictional electrification when the toner is electrified on the supply roller to have negative electricity.

It is preferable for the toner seal surface to be made of fluorine compound when the toner is electrified on the supply roller to have positive electricity.

The repelling electrostatic or coulomb force may be generated between the electrified toner and an electrification-remaining part on the latent image surface while the toner adheres to an electrification-discharged part on the latent image surface, or the attracting electrostatic or coulomb force may be generated between the electrified toner and the electrification-remaining part while the toner is prevented from adhering to the electrification-discharged part.

BRIEF DESCRIPTION OF THE DRAWINGS

FIG. 6 is a table showing relationships between materials of the toner seal surfaces and toner dispersion results.

FIG. 7 is a table showing relationships among the materials of the toner seal surfaces, pressing forces of the toner seal surface, toner density at non-printed sheet part (Background Density) and the toner dispersion results.

DETAILED DESCRIPTION OF PREFERRED EMBODIMENTS

Figure 1:
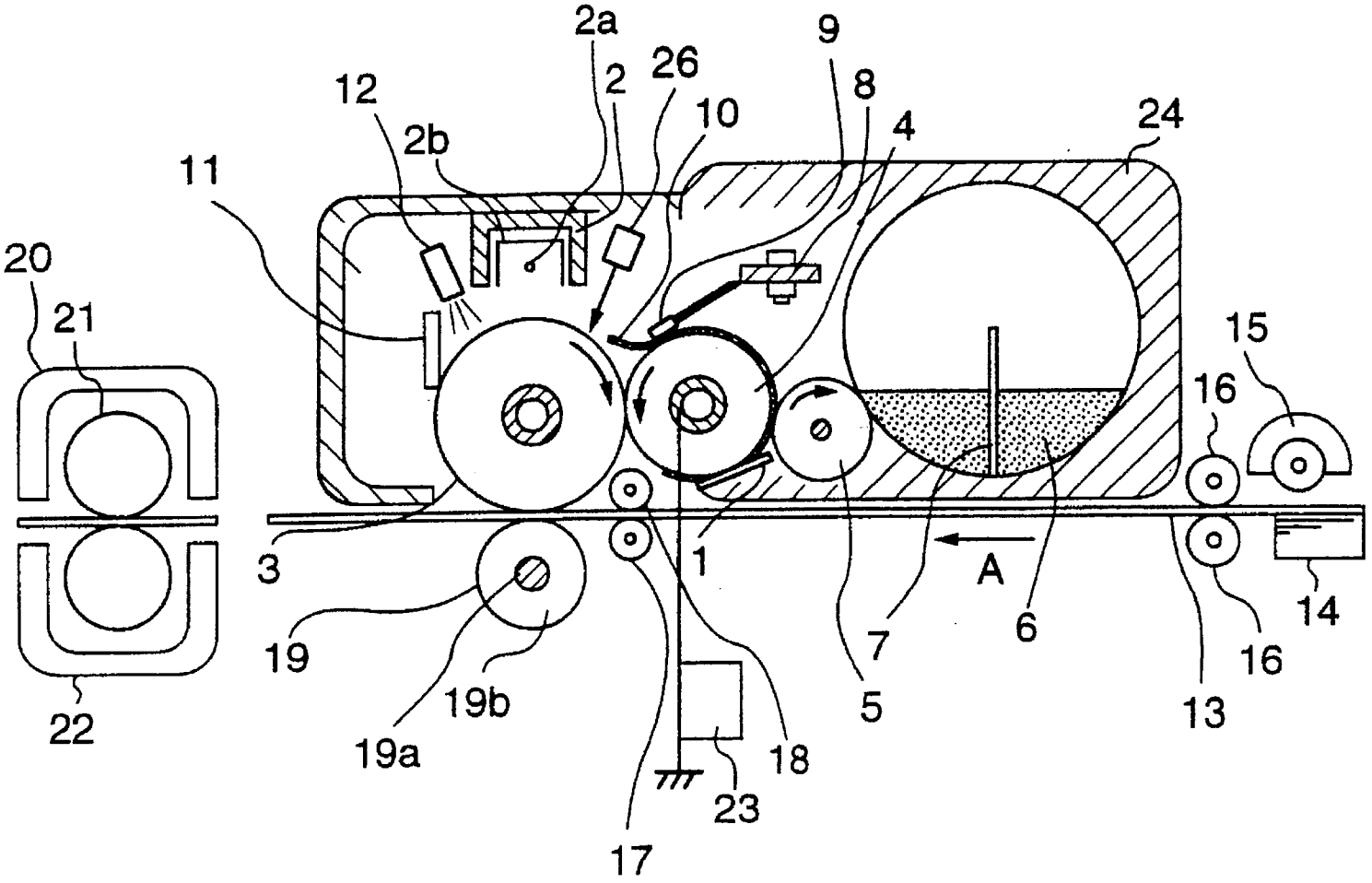
FIG. 1 is a schematic cross sectional view showing a developing apparatus of the present invention.

In a developing apparatus as shown in FIG. 1, a photosensitive drum 3 has an outer periphery surface layer made of a photoconductive organic material, for example, selenium (Se), to cover an aluminum core drum which is electrically grounded. An electrifier 2 is arranged adjacent to the photosensitive drum 3, and has an electrifying wire 2*a* of tungsten wire or the like and a metal shield 2*b*. The electrifying wire 2*a* generates corona discharge to electrify an outer periphery surface of the photosensitive drum 3 as the claimed latent image surface. A toner feed roller 5 is rotatably supported on a base chassis 24 to feed a non-magnetic (single component) toner from a toner reservoir to a toner supply roller 4. The toner is stirred in the toner reservoir and fed toward the toner feed roller 5 by a stirring member 7 formed by a rectangularly bent plate and rotated in accordance with a rotation of the toner feed roller 5. Each of the toner supply roller 4 and toner feed roller 5 has a metallic core drum made of, for example, stainless steel and an outer peripherary surface layer made of, for example, urethane rubber, silicone rubber or the like, and is rotatably supported at both longitudinal ends thereof on the base chassis 24. An end seal 10 is arranged at both of the longitudinal ends of the toner supply roller 4 to prevent the toner from the longitudinal ends of the toner supply roller 4.

The toner supplied from the toner feed roller 5 onto an outer peripheral surface of the toner supply roller 4 as the claimed supply surface is pressed against the outer peripheral surface of the toner supply roller 4 to become a thin layer and to be electrified securely by the toner supply roller 4 electrically energized by a bias electric power 23. The outer peripheral surface of the photosensitive drum 3 electrified by the electrifier 2 is partially electrically discharged by a light source 26, for example a LED head, a laser beam head or the like, to form an electrostatic latent image on the outer peripheral surface of the photosensitive drum 3. When the outer peripheral surface of the photosensitive drum 3 is electrified with a negative electricity, the toner on the outer peripheral surface of the toner supply roller 4 is electrified with the negative electricity. When the outer peripheral surface of the photosensitive drum 3 is electrified with a positive electricity, the toner on the outer peripheral surface of the toner supply roller 4 is electrified with the positive electricity. A repelling force is generated between the electrified toner and a non-electrically discharged part of the outer peripheral surface of the photosensitive drum 3 to prevent the toner from being transferred from the outer peripheral surface of the toner supply roller 4 to the non-electrically discharged part, and the toner adheres from the outer peripheral surface of the toner supply roller 4 to an electrically discharged part of the outer peripheral surface of the photosensitive drum 3, so that the electrostatic latent image is developed by the toner.

The toner is transferred from the outer peripheral surface of the photosensitive drum 3 to a work piece sheet 13 by attracting the electrified toner by a transfer roller 19 which is electrically energized. When the toner is electrified with the negative electricity, the transfer roller 19 is electrically energized with the positive electricity, and when toner is electrified with the positive electricity, the transfer roller 19 is electrically energized with the negative electricity, so that an attracting force is generated therebetween.

Reference numeral 8 designates an attachment member to which a developing blade 9 is fixed. Numeral 1 denotes a sealing member for preventing the toner 6 from flowing out of the base chassis 24. The sealing member 1 is provided in contact with the toner supply roller 4 on the base chassis 24, as shown in FIG. 1. The sealing member may be made of, for example, a metallic material such as SUS (stainless steel), aluminum or phosphor bronze, or a fluorine contained resin material such as urethane, PET (polyethylene terephthalate), PFA (polyfluoroacrylate) or PTFE (polytetrafluoroethylene).

Reference numeral 11 shows a cleaning blade for scratching off the toner 6 remaining on the photosensitive drum 3, and reference numeral 12 shows a charge relieving device for removing electric charges remaining on the photosensitive drum 3. Reference numeral 14 indicates a work piece cassette in which work piece sheets 13 are stocked. The work piece sheets 13 are sent out from the cassette 14 to a carrier roller 16 one by one by means of a sheet feed roller 15 having a semicircular cross section. The sent-out work piece sheet 13 is conveyed in a direction indicated by an arrow A in FIG. 1 by the carrier roller 16. Numeral 17 designates a registration roller for temporarily stopping and holding the work piece sheet 13 in order to cause an image formed by the toner 6 on the photosensitive drum 3 to coincide with a position of the work piece sheet 13. The registration roller 17 contacts a follower roller 18. A toner transfer roller 19 has a cylindrical shape as a whole, and it comprises a core 19*a* made of stainless steel or the like and a carbon-mixed spongy elastomer 19*b*. The toner transfer roller 19 is arranged so that a nip having a predetermined width is defined between the photosensitive drum 3 and the toner transfer roller 19. By applying a bias having a polarity opposite to that of the toner 6 to the core 19*a* of the toner transfer roller 19, the image formed by the toner 6 on the photosensitive drum 3 is transferred onto the work piece sheet 13. The toner transfer roller 19 is rotatably connected to the base chassis 24 by bearing means. A distance between axes of the toner transfer roller 19 and the photosensitive drum 3 is predetermined at a value obtained by adding a radius of the transfer drum 19 and a radius of the photosensitive drum 3 and subtracting a depth of thrust of the elastic toner transfer roller 19 with respect to the photosensitive drum 3, from the total length of the radii of the transfer roller 19 and the photosensitive drum 3. Image fixing means comprises a heat roller 21 having a heat source therein, and a pressure roller 22. The image formed by the toner 6 transferred onto the work piece sheet 13 is fixed on the work piece sheet 13 by the pressure and heat of the image fixing means 20 when the sheet 13 passes between the rotating heat roller 21 and pressure roller 22.

Figure 2A:
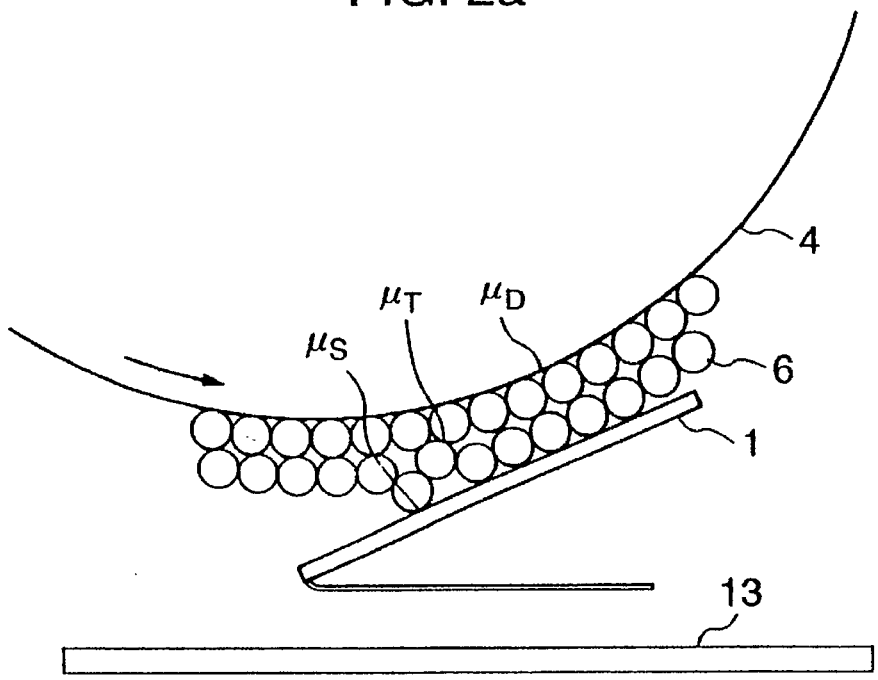
FIG. 2*a* is a schematic view showing a toner arrangement obtained when a frictional coefficient between a toner and a toner supply surface and a frictional coefficient between the toner and the toner are higher than a frictional coefficient between the toner and a toner seal surface.
Figure 2B:
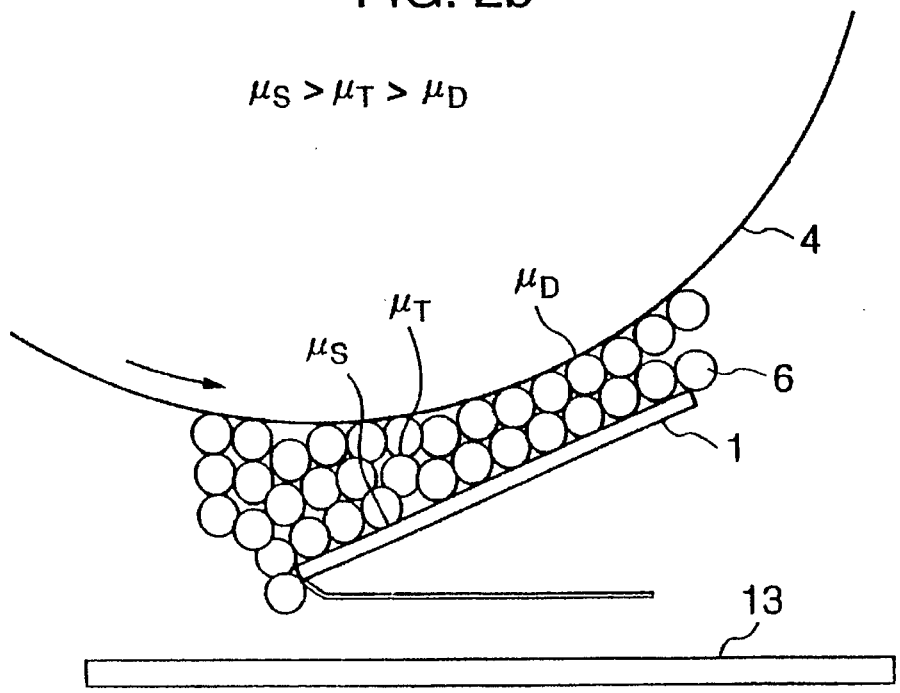
FIG. 2*b* is a schematic view showing another toner arrangement obtained when the frictional coefficient between the toner and the toner supply surface is lower than the frictional coefficient between the toner and the toner, and the frictional coefficient between the toner and the toner is lower than the frictional coefficient between the toner and the toner seal surface.

FIGS. 2*a* and 2*b* are schematic views each explaining a condition of the toner around the sealing member 1 in the developing apparatus according to one embodiment of the invention. In the case where frictional coefficients between the toner 6 and the toner supply roller 4, between particles of the toner 6, and between the toner 6 and the sealing member 1 are expressed by $\mu D$, $\mu T$, $\mu S$, respectively, FIG. 2*a* shows a state of the toner in which relations of $\mu D > \mu S$ and $\mu T > \mu S$ are satisfied. Under this condition, because $\mu S$ is the lowest of the three, the toner 6 adhering to the sealing member 1 is removed by the toner supply roller 4 and the remaining toner 6 which does not stick to the sealing member 1, without accumulating on the sealing member. The removed toner is collected and finally recovered within the base chassis 24. As a result, the toner 6 does not accumulate on the sealing member 1 even in case of long-time use of the developing apparatus. Accordingly, it is possible to suppress occurrence of indefiniteness of the image caused by scatter of the toner.

FIG. 2*b* shows one example in which the above-described relations such as $\mu D>\mu S$ and $\mu T>\mu S$ are not satisfied, e.g. a state in which a relation of $\mu D<\mu T<\mu S$ exists. Because $\mu S$ is the highest of the three, the toner 6 once sticking to the sealing member 1 stagnates on this sealing member and accumulates thereon during long-time use of the developing apparatus because $\mu D$ is lower than $\mu T$. Consequently, the toner 6 flows out and scatters on the work piece sheet 13, which results in indefiniteness of the image.

FIG. 6 shows results of an experiment carried out utilizing various materials for the sealing member 1.

Figure 4:
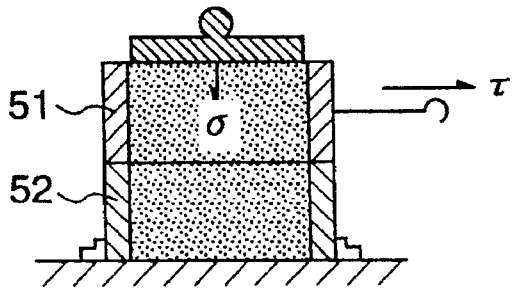
FIG. 4 is a schematic cross sectional view showing a method for measuring the frictional coefficient between the toner and the toner.

The photosensitive drum 3 used in the experiment was made of a photoconductive organic material electrified with a negative electricity, and the toner supply roller 4 was made of conductive silicone rubber which contains carbon black and which has a resistance value of about $10^6$ Ω·cm. A surface roughness (an average value of roughness at ten points of the surface) of the toner supply roller 4 was adjusted at 4.2 μm. The toner supply roller 4 was positioned so as to thrust into the photosensitive drum 3 by a depth of 1 mm. The toner 6 used in the experiment was a styrene acrylic toner electrified with a positive electricity, the toner having a diameter of 8 μm (volume percent: 50%). A pressing force of the sealing member 1 with respect to the toner supply roller 4 was set at 25 g/cm. The type of the development was non-magnetic single component toner contacting development, and this was normal-rotation development. The frictional coefficients $\mu D$, $\mu T$, $\mu S$ at that time were measured by a direct single shear method. According to the principle of the direct single shear method, as shown in FIG. 4, one cell 51 is put on another cell 52, and powder is fully filled in the cells. The cell 52 is fixedly held, and the cell 51 is pulled horizontally while applying a normal stress $\sigma$ to the cell 51. When a layer of the powder is sheared, a pulling stress $\tau$ is measured. By measuring the pulling stress $\tau$, an internal frictional coefficient $\mu$ of the powder can be obtained from a relation of $\tau=\mu\sigma$.

In the actual measurement, rings each having an outer diameter of 76 mm, and an inner diameter of 61 mm and a height of 5 mm were used as the cells 51 and 52. Also a height of a layer of the toner 6 in each of the upper and lower cells was 5 mm, and a shearing speed was 0.1 mm/sec. Additionally the load was 400 g/cm$^2$.

Figure 5:
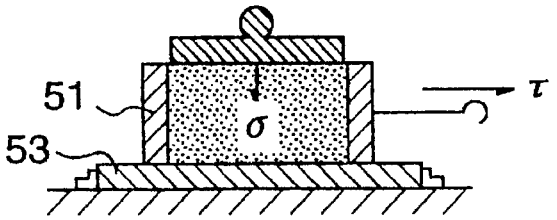
FIG. 5 is a schematic cross sectional view showing a method for measuring the frictional coefficient between the toner and the toner seal surface or supply surface.

Further, as shown in FIG. 5, the above-described cell 51 was put on a fixed plate 53 made of the same material as the sealing member 1 or the toner supply roller 4 and having the same surface roughness as that of the sealing member 1 or the toner supply roller 4, and the cell 51 was pulled horizontally under such a condition that a load was applied to the cell. Then, the frictional coefficients between the sealing member 1 and the toner 6 and between the toner supply roller 4 and the toner 6 were measured.

In the actual measurement, the height of the layer of the toner 6 was 5 mm, a moving speed of the cell 51 was 0.1 mm/sec, and the load was 400 g/cm$^2$.

As understood from the above-mentioned measurements the frictional coefficients $\mu D$ and $\mu T$ were 0.58 and 0.39, respectively. By applying surface treatment on the sealing member 1, the frictional coefficient $\mu S$ was 0.21 when PTFE was used as the material for the sealing member 1, 0.32 when PET was used, 0.40 when urethane rubber was used, and 0.58 when silicone rubber was used. As for the evaluation method, after a 10,000 sheet printing test was finished in each case, the printing condition of each case was evaluated in the following manner.

⊙: a condition in which there is no scattering of the toner 6

⊙: a condition in which there is substantially no scattering of the toner 6

Δ: a condition in which a scattering of the toner 6 is seen x: a condition in which a scattering of the toner 6 is considerably seen As apparently recognized from the results of FIG. 6, according to the present invention, the sealing member 1 was made of the material applied with the surface treatment which satisfies such relations as $\mu D>\mu S$ and $\mu T>\mu S$ wherein the frictional coefficients between the toner 6 and the toner supply roller 4, between the toner 6 and the toner 6 and between the toner 6 and the sealing member 1 were expressed by $\mu D$, $\mu T$ and $\mu S$. Because the frictional coefficient between the toner 6 and the sealing member 1 was lower than the other coefficients, the toner 6 could be prevented from accumulating on the sealing member 1 and from scattering out of the developing apparatus, thereby suppressing degradation of the image such as soil in the image.

As a result of the experiment using the various materials, fluorine materials by which the scattering of the toner 6 was not seen, were selected. FIG. 7 (Table 2) shows results of an experiment of the fluorine material sealing members under the same conditions as Table 1. The experiment was conducted while varying the pressing force of the sealing member 1 with respect to the toner supply roller 4.

Figure 3:
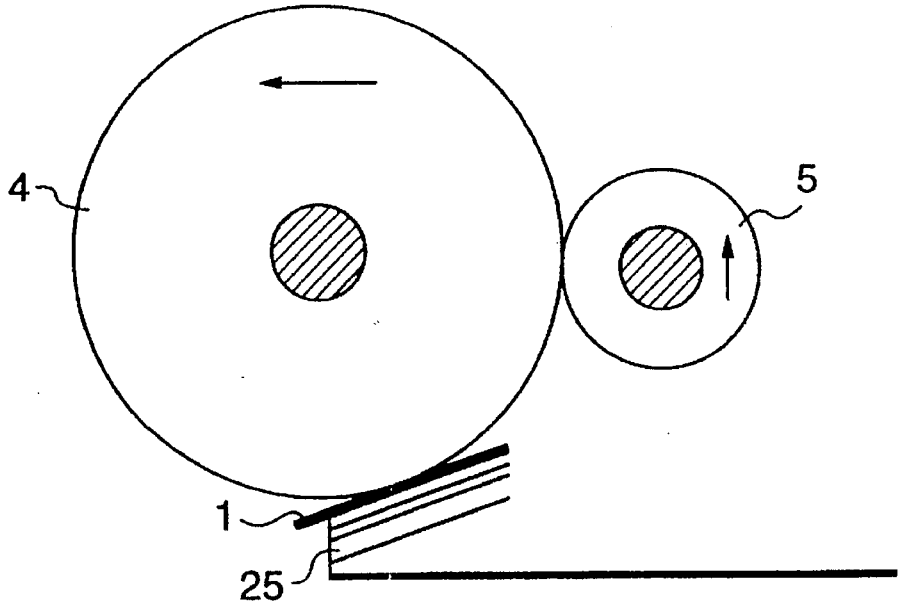
FIG. 3 is a schematic view showing a toner supply roller, a toner feed roller and the toner seal.

In the experiment, the pressing force of the sealing member 1 was adjusted by means of a spacer 25, as shown in FIG. 3. As for the evaluation method, after a 10,000 sheet printing test was finished in each case, the printing condition was evaluated in the same manner as in Table 1 and image fogging (background density, i.e., B.G. density) was measured by a Hunter whiteness meter.

As understood from the results of FIG. 7 (Table 2), in the case where toner 6 electrified with positive electricity was used, because the charge amount of the toner 6 was not weakened, when the fluorine-material film having a polarity opposite to that of the electricity of the toner was used, the B.G. density was not more than 0.5 and could not be perceived visibly. Accordingly, a desirable image having no fogging could be obtained. The optimum value of the contact pressure between the sealing member 1 and the toner supply roller 4 was not more than 30 g/cm. This is because the stress applied to the toner 6 on the toner supply roller 4 is so large that the toner 6 is welded on the sealing member 1 when the contact pressure exceeds 30 g/cm, which results in a problem such as scattering of the toner 6 or the like.

The results of any of the above-described experiments were obtained from normal-rotation development. In contrast with this, replacing the photosensitive drum 3 with a photosensitive organic drum electrified with a positive electricity, reverse-rotation development was performed according to a similar developing method, and an experiment was carried out by the same materials using the above-described experiments. Substantially the same results could be obtained.

What is claimed is:

1. A developing apparatus comprising:

a toner reservoir for holding a non-magnetic toner, a toner supply roller including a substantially cylindrical supply surface for receiving the toner from the toner reservoir and electrifying the toner thereon, an electrostatic latent image carrier including a latent image surface on which a latent image formed by an electrostatic voltage distribution thereon is developed by the toner transferred from the supply surface, and a toner seal surface arranged adjacent to the toner supply roller to contact a remaining part of the toner on the supply surface after the latent image development so that the remaining part of the toner is taken into the toner reservoir, wherein a disturbance of toner condition between the toner and toner seal surface is prevented and the disturbance of toner condition is prevented by providing a frictional coefficient between the toner seal surface and the toner which is lower than a frictional coefficient between particles of the toner.

2. A developing apparatus according to claim 1, wherein a frictional coefficient between the toner seal surface and the toner is lower than a frictional coefficient between the toner and the supply surface.

3. A developing apparatus according to claim 1, wherein a frictional coefficient between particles of the toner is lower than a frictional coefficient between the toner and the supply surface.

4. A developing apparatus according to claim 1, wherein a pressing force between the toner seal surface and the supply surface is not more than 30 g/cm.

5. A developing apparatus comprising:

a toner reservoir for holding a non-magnetic toner, a toner supply roller including a substantially cylindrical supply surface for receiving the toner from the toner reservoir and electrifying the toner thereon, an electrostatic latent image carrier including a latent image surface on which a latent image formed by an electrostatic voltage distribution thereon is developed by the toner transferred from the supply surface, and a toner seal surface arranged adjacent to the toner supply roller to contact a remaining part of the toner on the supply surface after the latent image development so that the remaining part of the toner is taken into the toner reservoir, wherein a disturbance of toner condition between the toner and toner seal surface is prevented and the toner seal surface is made of a fluorine compound and the toner is electrified on the supply roller to have positive electricity.

6. A developing apparatus comprising:

a toner reservoir for holding a non-magnetic toner, a toner supply roller including a substantially cylindrical supply surface for receiving the toner from the toner reservoir and electrifying the toner thereon, an electrostatic latent image carrier including a latent image surface on which a latent image formed by an electrostatic voltage distribution thereon is developed by the toner transferred from the supply surface, and a toner seal surface arranged adjacent to the toner supply roller to contact a remaining part of the toner on the supply surface after the latent image development so that the remaining part of the toner is taken into the toner reservoir, wherein a disturbance of toner condition between the toner and toner seal surface is prevented and when the toner is electrified on the supply roller to have positive electricity, the toner seal surface is arranged between the toner and a negative end with respect to a series of frictional electrification.

7. A developing apparatus comprising:

a toner reservoir for holding a non-magnetic toner, a toner supply roller including a substantially cylindrical supply surface for receiving the toner from the toner reservoir and electrifying the toner thereon, an electrostatic latent image carrier including a latent image surface on which a latent image formed by an electrostatic voltage distribution thereon is developed by the toner transferred from the supply surface, and a toner seal surface arranged adjacent to the toner supply roller to contact a remaining part of the toner on the supply surface after the latent image development so that the remaining part of the toner is taken into the toner reservoir, wherein a disturbance of toner condition between the toner and toner seal surface is prevented and when the toner is electrified on the supply roller to have negative electricity, the toner seal surface is arranged between the toner and a positive end with respect to a series of frictional electrification.

* * * * *